US006719046B2

(12) United States Patent
Mullins

(10) Patent No.: US 6,719,046 B2
(45) Date of Patent: Apr. 13, 2004

(54) APPARATUS FOR CONTROLLING THE ANNULUS OF AN INNER STRING AND CASING STRING

(76) Inventor: Albert Augustus Mullins, 18706 Acaro Glen Ct., Humble, TX (US) 77346

( * ) Notice: Subject to any disclaimer, the term of this patent is extended or adjusted under 35 U.S.C. 154(b) by 0 days.

(21) Appl. No.: 10/390,984

(22) Filed: Mar. 17, 2003

(65) Prior Publication Data

US 2003/0178192 A1 Sep. 25, 2003

Related U.S. Application Data

(60) Provisional application No. 60/366,115, filed on Mar. 20, 2002.

(51) Int. Cl.[7] ..... E21B 33/127

(52) U.S. Cl. ..... 166/179; 166/142; 166/143; 166/146; 166/183; 166/187; 166/188

(58) Field of Search ..... 166/72, 142, 187, 166/143, 146, 183, 188

(56) References Cited

U.S. PATENT DOCUMENTS

| | | | | | |
|---|---|---|---|---|---|
| 4,573,535 | A | * | 3/1986 | Manke | 166/321 |
| 5,479,989 | A | * | 1/1996 | Shy et al. | 166/332.4 |
| 5,743,333 | A | * | 4/1998 | Willauer et al. | 166/122 |
| 6,044,908 | A | * | 4/2000 | Wyatt | 166/332.4 |

* cited by examiner

*Primary Examiner*—Roger Schoeppel
(74) *Attorney, Agent, or Firm*—Steve Rosenblatt

(57) ABSTRACT

A apparatus is disclosed for attaching and sealing to the upper end of the casing allowing the inner string to be run through the apparatus. The apparatus provides a latch for anchoring the inner string and a seal for sealing on the inner string. Also disclosed is a flow path for providing for circulation of fluid between the inner string and casing annulus. Also disclosed is an inner string sub that provides a profile anchoring and sealing the inner string by the apparatus.

18 Claims, 4 Drawing Sheets

APPARATUS FOR CONTROLLING THE ANNULUS OF AN INNER STRING AND CASING STRING

PRIORITY INFORMATION

This application claims the benefit of U.S. Provisional Application No. 60/366,115 on Mar. 20, 2002.

FIELD OF THE INVENTION

The field of this invention relates to a method of anchoring, sealing and circulating between a casing string and inner string therein.

BACKGROUND OF THE INVENTION

With the use of casing strings in wells, having small clearances between each string, it has become more common to run the casing string open ended to allow the fluid below the casing to escape through the inside of the casing to prevent an increase in pressure in the well that could break down the formation and cause a well control problem.

In order to run a casing string of this type into a sub sea well head it is necessary to run the casing inside the riser then attach a casing hanger and running tool to the casing and run the assembly in the well to the sub, sea tree using drill pipe. Normally the casing can then be cemented in place using conventional cementing plugs located at the hanger running tool and launched by dropping a ball or other device from the rig floor. In some instances it is desirable to run pipe below the hanger running tool to or near the bottom of the casing being run. This will eliminate the need for cementing plugs since there is no need to wipe the casing with cementing wiper plugs.

Should the well begin to flow the blow out preventer can be closed on the casing string isolating the annulus between the casing string being run and the well bore. The drill pipe being run inside the casing can also be isolated by connecting it to a top drive or by attaching a safety valve to the upper most joint of drill pipe. However this leaves the casing drill pipe (inner string) annulus open thereby exposing the well to extreme danger.

It is therefore clear there is a need for a device to isolate the annulus between the inner string and the casing string during the process of running the inner string inside the casing string.

Not only is it desirable to isolate this annulus space by placing a seal between the two members, it is also necessary to anchor the inner string to the casing string to prevent internal pressure in the casing string from pushing the inner string out of the well.

It is therefore clear there is a need for a device to anchor the inner string to the casing to prevent it from dropping into the well or being blown out of the well.

Should a gas bubble exist it must be circulated out of the well to place the well back under control. In order to circulate the well it is common practice to pump mud into the most inner string, in this case the drill pipe or inner string and out the annulus around the drill pipe.

It is therefore clear there is a need for a device to provide a means of circulating fluid through the well.

A device is disclosed that can be attached to the upper end of the casing string or casing hanger that will anchor the inner string to the casing to prevent it from moving. A seal is also disclosed that will seal the annulus between the inner string and casing at the surface, the device also provides for circulating fluid through the annulus space between the casing string and inner string.

Accordingly, it is an object of the present invention to provide a apparatus useful for anchoring, sealing and providing a circulation path in a casing string having an inner string. Accordingly, an apparatus is disclosed that provides for attaching and sealing to the upper end of the casing string or hanger and provides for the inner string to be run through the apparatus. A means of anchoring the inner string to the apparatus is also provided. Accordingly, an apparatus that provides a flow path for circulating fluid is disclosed. These and other objectives accomplished by the apparatus will become more apparent from a review of the detailed description below.

SUMMARY OF THE INVENTION

A apparatus is disclosed for attaching and sealing to the upper end of the casing allowing the inner string to be run through the apparatus. The apparatus provides a latch for anchoring the inner string and a seal for sealing on the inner string. Also disclosed is a flow path for providing for circulation of fluid between the inner string and casing annulus. Also disclosed is an inner string sub that provides a profile anchoring and sealing the inner string by the apparatus.

For running the inner string the apparatus provides an opening that does not restrict the passage of the tool joints of the inner string. Once it is decided to anchor or seal on the inner string the inner string sub is attached to the upper most joint of the inner string. This inner string sub is then lowered into the apparatus until the latching profile and seal area of the inner string sub is adjacent the latch and seal in the apparatus. The latch is then set by hydraulic pressure. The latch is tested by pulling or pushing (raising or lowering) the inner string. The seal can then be set by hydraulic pressure. Circulating fluid either into the casing inner string annulus or the inner string can test the seal.

DETAILED DESCRIPTION OF THE PREFERRED EMBODIMENT

Figure 1:
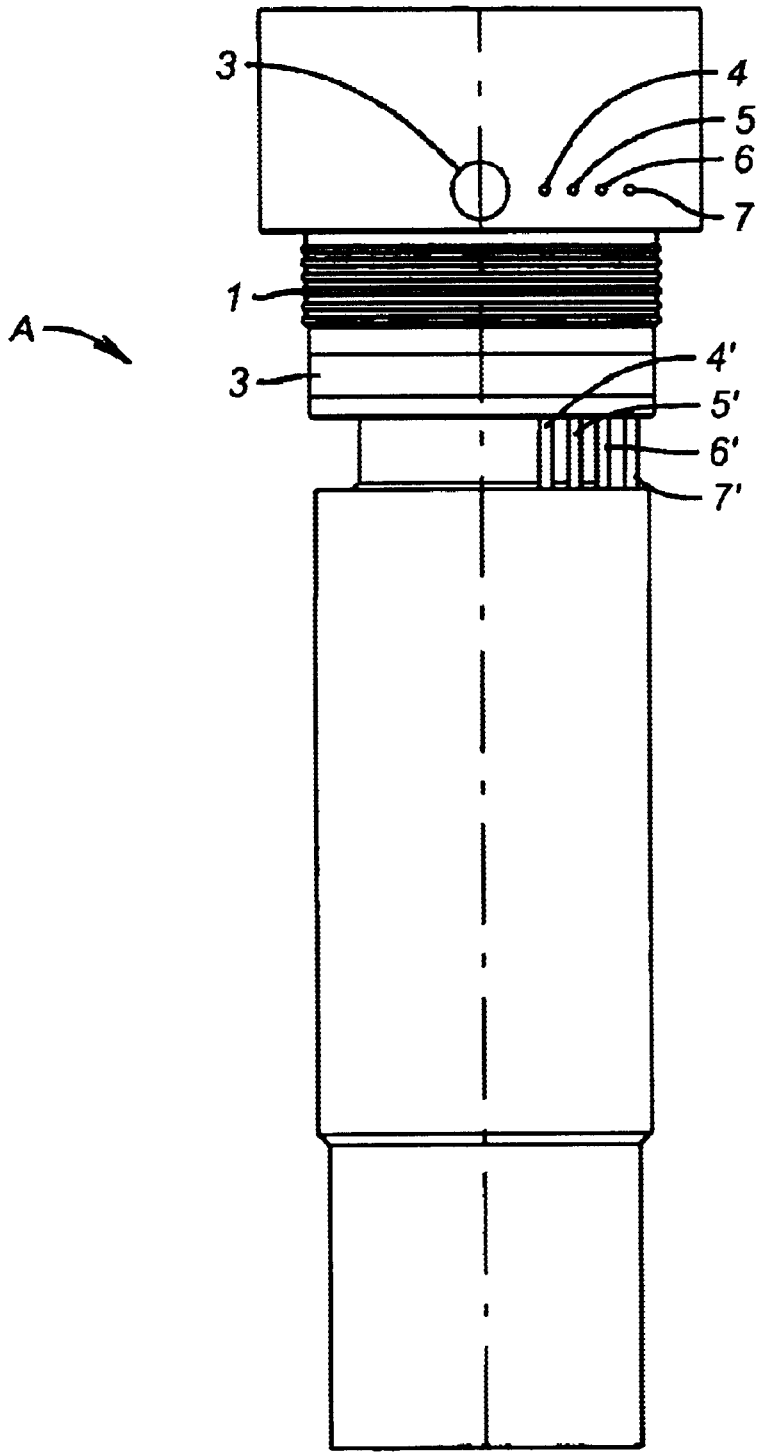
FIG. 1 is an elevational view of the apparatus.
Figure 2:
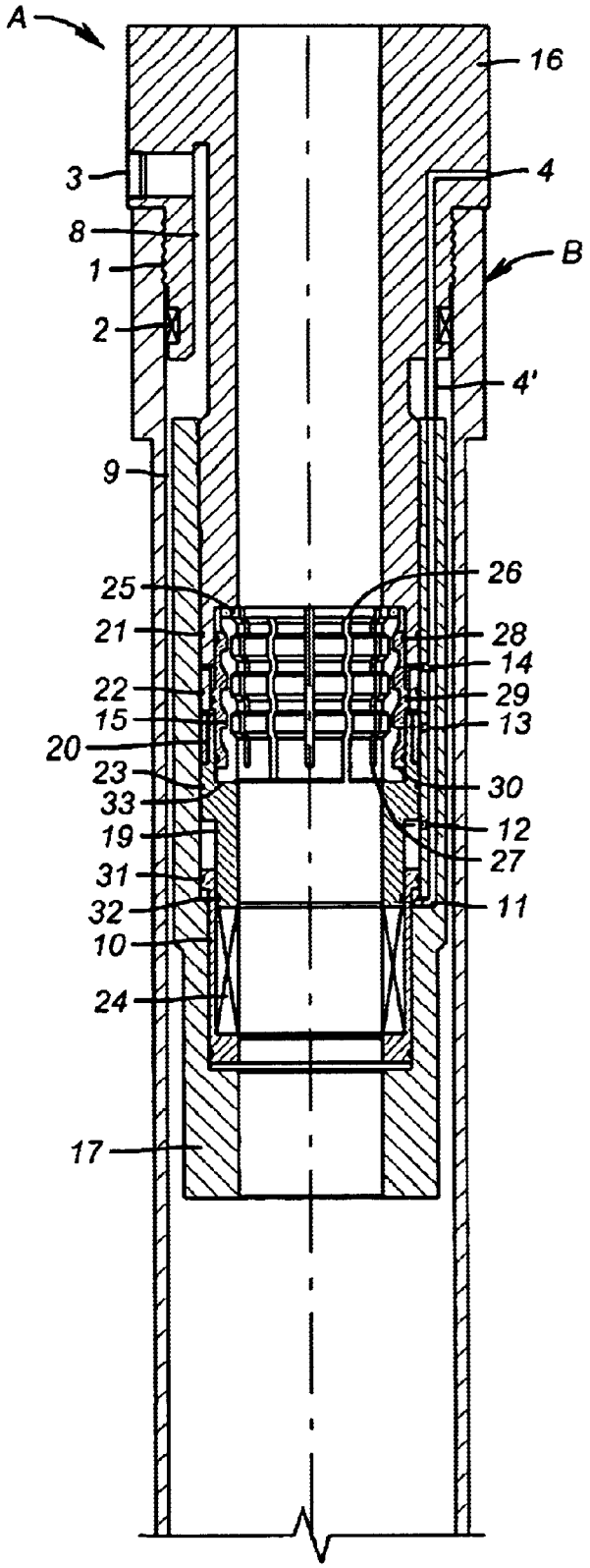
FIG. 2 is a sectional elevational view of the apparatus attached to the upper end of the casing string.

Referring to FIG. 1, an outer view of apparatus A is shown to illustrate the general location of components. Illustrated is a thread or latch 1 to engage the threads of the upper casing joint or profile of a hanger not shown in this illustration. The location of a seal 2 for sealing with the casing is illustrated. Also shown is the circulation port 3 whose purpose will be described later. Hydraulic ports 4, 5, 6 and 7 are illustrated. These ports are connected through hydraulic lines 4', 5', 6' and 7' to the latch and seal not shown in this illustration. Referring to FIG. 2, the apparatus A is shown connected to the upper end of the casing B by threads or latch 1 and sealed with the casing with seal 2. The casing B is supported at the rig floor with slips or spider not shown. The circulating port 3 is connected to the inside of the casing B through passage 8 and annular area 9 between the casing B and apparatus A. For simplicity only hydraulic port 4 and hydraulic line 4' are shown. Hydraulic port 4 is connected to the lower end of the seal setting piston 10 through port 11. Ports 5, 6 and 7 of FIG. 1 are connected through their respective passages to ports 12, 13 and 14. Ports 12, 13 and 14 are shown out of position to simplify the illustration. Each port will be rotationally displaced as are passages 5, 6 and 7 of FIG. 1. So, hydraulic passage 5 of FIG. 1 is connected to the upper end of the seal setting piston 10 through port 12, hydraulic passage 6 of FIG. 1 is connected to the lower end of the latch piston 15 through port 13, and hydraulic passage 7 of FIG. 1 is connected to the upper end of the latch piston 15 through port 14.

Seals 21, 22, and 23 isolate ports 11, 12, 13 and 14 from each other inside of lower housing 16.

Upper housing 16 of the apparatus is connected to lower housing 17 with threads 18. Latch Housing 19 is attached to upper housing 16 with threads 20.

Seal 24 is shown in its normally released position. It is clear that the seal 24 can be set by pressuring through hydraulic port 4 of FIG. 1 to the lower end of the seal setting sleeve 10. Seal 24 is maintained in the released position by application of hydraulic pressure being applied through port 6 then passing through internal passageways to port 12 located at the upper end of seal setting piston 10 and acting on the annular area between seals 31 and 32.

The latch 25 is shown in its normal released position with the inner profile of the latch piston 15 in the mating contact with the outer profile of the latch 25 so that the latch 25 is in its expanded (normally relaxed) position. Latch 25 is preferably a single piece design providing for expansion and contraction and formed from a tubular having slots 26 and 27 alternately formed from opposite ends and terminating prior to exiting the part. Latch piston 15 is held in the latch 25 release position with hydraulic pressure applied in the area between seal 28 and 29 through ports 7 and 14. As pressure is applied to port 7 it advances through the internal paths to port 14 thereby forcing latch piston 15 downward into contact with latch 25 at shoulder 30. Latch 25 in turn is forced into contact with latch housing 19 at shoulder 33.

Figure 3:
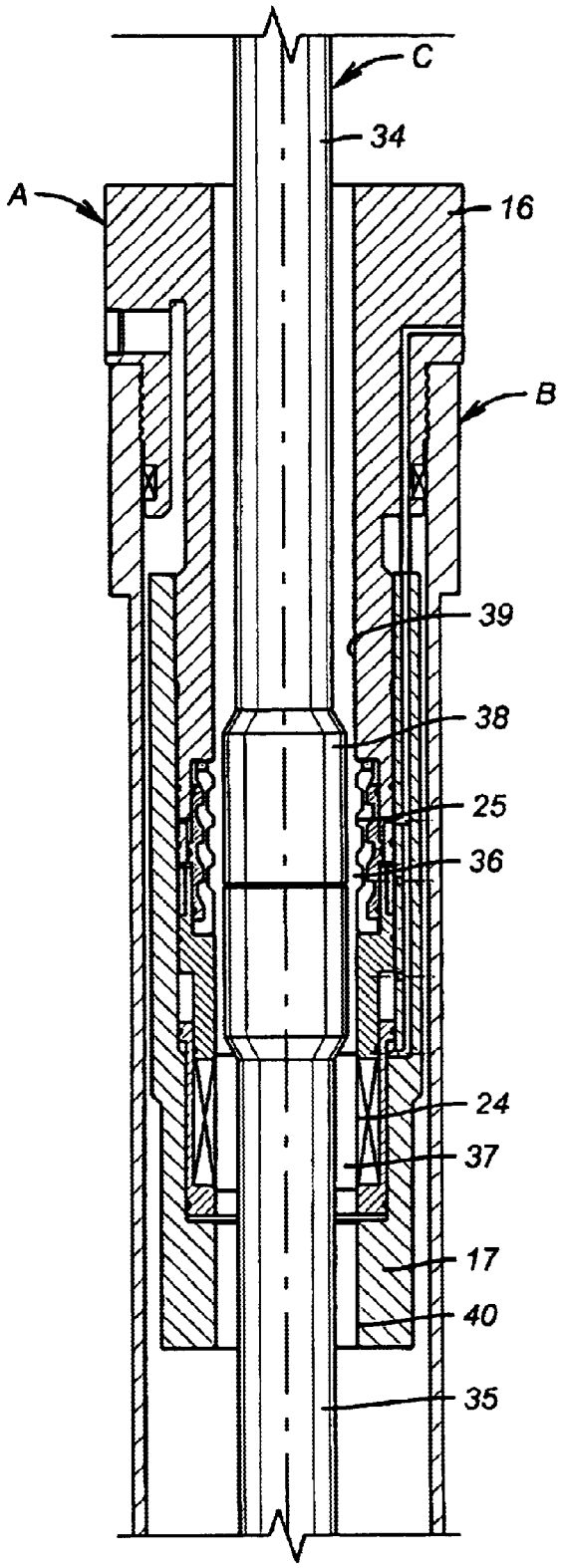
FIG. 3 is the view of FIG. 2, except that the inner string is being run through the apparatus.

Referring to FIG. 3. The apparatus A is shown connected to the casing B with the inner string C being run through the apparatus. In this view inner string C consists of adjacent joints of pipe 34 and 35. Shown in the view are the spaces 36 and 37 created when the seal 24 and latch 25 are in the released position. In this position adjacent joints of pipe may be continuously added or removed from the inner string C without damage to the seal 24 or latch 25. To prevent the upset 38 of the inner string C from damaging the latch 25 or seal 24 the inner diameter 40 of the lower housing 17 and the inner diameter 39 of the upper housing 16 are both smaller than the inner diameters of the latch 25 and seal 24 when in the released or retracted positions.

Figure 4:
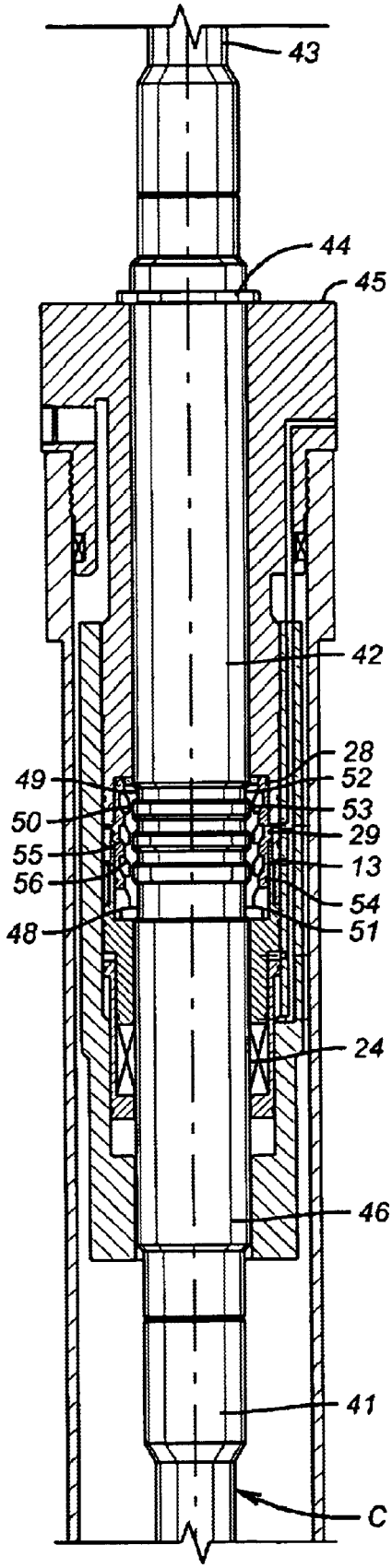
FIG. 4 is a sectional elevational view of the apparatus in FIG. 2, except that the inner string sub has been attached to the inner string and positioned in the apparatus with the latching device and seal activated to anchor and seal the inner string with the apparatus.

Referring to FIG. 4. The apparatus is shown with the inner string sub 42 attached to the uppermost joint of pipe 41 in the inner string C. Another joint of pipe 43 is connected to the upper end of the inner string sub 42. The upper joint of pipe 43 can be connected to the rig hoisting system so as to manipulate the inner string by raising or lowering it.

The inner string sub 42 has formed on its outside surface a set of profiles 48, 49 and 50 for engagement with mating profiles 51, 52 and 53 respectfully. Profile 51 of the latch 25 is preferably longer than any of the profiles on the inner string sub 42 other than the lowermost profile 48. These longer profiles 48 and 51 prevent the latch 25 from contracting until all profiles are located to their respective mates. For this reason, once the inner string sub 42 is inserted into the apparatus such that the seal diameter 46 is through the latch 25, hydraulic pressure can then be applied through port 7 of the apparatus through the inner passages and to port 13, seals 29 and 54. Pressure applied to this area will force latch piston 15 upward. This upward force on latch piston 15 will cause surface 55 of the latch piston to ride up surface 56 of the latch 36 forcing latch 36 inward into contact with the outer surface of seal area 46 on the inner string sub 42. As the inner string C is then lowered the profiles on the inner string sub 42 will be placed adjacent to the profiles of the latch 25. With pressure being applied to the area on the latch piston 15 the latch 26 will be forced into mating contact with the profiles of the inner string sub 42. This will lock the inner string C in place so that it can not move upward or downward thereby assuring the seal surface 46 is always adjacent to the seal 42.

Should pressure not be applied to the Latch piston 15 to position the profiles adjacent to each other, lowering the inner string C will eventually cause shoulder 44 on the inner string sub 42 to come into contact with the upper surface 45 of the upper housing 16 causing the inner string C to stop in a position that the profiles on the inner string sub 42 will be placed adjacent to the profile in the latch 36. This will also place the seal surface of the inner string sub 42 adjacent the seal 24.

Once in this position the latch 36 and seal 24 can be placed in locking and sealing contact with the inner string mandrel 42 by applying pressure to their respective ports.

Although a seal 24 is shown which takes an axial force to actuate other types of seals can be used such as those that have a chevron shape that will seal without actuation. Although a hydraulic means is described to actuate the latch 36 other types of actuation such as mechanically moving the latch piston 1 are envisioned.

Once the inner string sub 42 is secured by the latch 36, pressure in the annular area between the casing B and inner string C can be controlled. Circulation into or out of this annulus is possible through port 3 as described earlier.

The system is released by bleeding the pressure from the latch and seal ports causing them to retract away from the inner string sub 42.

I claim:

1. An apparatus for controlling the annulus between an outer and an inner string, comprising:

a sleeve secured to the outer string and having a central passage selectively large enough to allow passage of the inner string and selectively operated to seal around said inner string in said passage for closing the annulus.

2. The apparatus of claim 1, further comprising:

a passage in said sleeve to allow selective access into said annulus.

3. The apparatus of claim 1, further comprising:

a seal on said sleeve movable between a retracted position for letting the inner string pass unimpeded and a set position for sealing between said sleeve and said inner string.

4. The apparatus of claim 1, further comprising:

a latch on said sleeve movable between a retracted position for letting the inner string pass unimpeded and a set position for gripping said inner string for support from said sleeve.

5. The apparatus of claim 4, further comprising:

a profile sub insertable into the inner string and further comprising a first latching profile, said latch on said sleeve comprising a second latching profile to engage said first latching profile on said profile sub for retaining the inner string to said sleeve.

6. The apparatus of claim 5, further comprising:

a travel stop on said profile sub to position said first latching profile adjacent said second latching profile in said sleeve.

7. The apparatus of claim 6, further comprising:

said travel stop engages said sleeve when said latching profiles are positioned adjacent each other.

8. The apparatus of claim 4, further comprising:

a seal on said sleeve movable between a retracted position for letting the inner string pass unimpeded and a set position for sealing between said sleeve and said inner string.

9. The apparatus of claim 8, further comprising:

a profile sub insertable into the inner string and further comprising a first latching profile, said latch on said sleeve comprising a second latching profile to engage said first latching profile on said profile sub for retaining the inner string to said sleeve.

10. The apparatus of claim 9, further comprising:

a seal diameter on said profile sub that is aligned with said seal when said latching profiles are adjacent each other.

11. The apparatus of claim 10, further comprising:

a travel stop on said profile sub to align said seal diameter thereon with said seal on said sleeve.

12. The apparatus of claim 11, further comprising:

a passage in said sleeve to allow selective access into said annulus.

13. The apparatus of claim 9, further comprising:

said latching profiles comprise mating undulating surfaces when said second latching profile is driven into contact with said first latching profile.

14. The apparatus of claim 13, further comprising:

the spacing between one pair of undulations on said latching profiles is longer than the remaining pairs of undulations to promote initial alignment of all undulations when said second latching profile is actuated.

15. The apparatus of claim 13, further comprising:

an actuating piston having a piston undulating profile comprising a plurality of first peaks, said latch on said sleeve comprising a third undulating profile comprising a plurality of second peaks, whereupon movement of said actuating piston, said first and second peaks move into alignment to force said latch on said sleeve into gripping engagement with said first latching profile on said profile sub.

16. The apparatus of claim 15, further comprising:

said actuating piston is driven in opposed directions by fluid pressure.

17. The apparatus of claim 16, further comprising:

said seal is actuated by a piston in opposed directions by fluid pressure.

18. The apparatus of claim 8, further comprising:

said seal and said latch are mounted in recesses on said sleeve, when in their said retracted position to avoid contact with said inner string.

* * * * *